US007823424B2

(12) United States Patent
Shabtay et al.

(10) Patent No.: US 7,823,424 B2
(45) Date of Patent: Nov. 2, 2010

(54) BICYCLE LOCK

(76) Inventors: Yaniv Shabtay, 155 Regents Park Rd., London (GB) NW1 8BB; Xu Ju Xiang, Ult 08, 15 F/C Huang-Jia Mansion, Guang-Cheng Rd, Wenzhou, Zhenjang (CN)

( * ) Notice: Subject to any disclaimer, the term of this patent is extended or adjusted under 35 U.S.C. 154(b) by 0 days.

(21) Appl. No.: 12/556,271

(22) Filed: Sep. 9, 2009

(65) Prior Publication Data

US 2009/0320531 A1 Dec. 31, 2009

Related U.S. Application Data

(62) Division of application No. 11/231,526, filed on Sep. 21, 2005, now Pat. No. 7,665,333.

(30) Foreign Application Priority Data

Sep. 21, 2004 (EP) ..... 04022383

(51) Int. Cl.
*E05B 67/22* (2006.01)

(52) U.S. Cl. ..... 70/38 A; 70/49; 70/39; 70/233

(58) Field of Classification Search ..... 70/38 A, 70/49, 39, 42, 233, 52, 53
See application file for complete search history.

(56) References Cited

U.S. PATENT DOCUMENTS 3,979,931 A * 9/1976 Man ..... 70/38 A
4,064,716 A * 12/1977 Shwayder et al. ..... 70/38 A
4,138,868 A * 2/1979 Richards, Sr. ..... 70/38 A
4,325,238 A * 4/1982 Scherbing ..... 70/18

(Continued)

FOREIGN PATENT DOCUMENTS

DE 9407300 8/1994
DE 4322989 1/1995

*Primary Examiner*—Peter M Cuomo
*Assistant Examiner*—Kristina R Fulton
(74) *Attorney, Agent, or Firm*—Robert W. Becker; Robert W. Becker & Assc.

(57) ABSTRACT

A bicycle lock in the form of a cable lock includes an elongated lock body and a cable having first and second ends. The first end is fixed to one end of the elongated lock body and another end of the lock body has an insertion opening for an insertion pin that is attached to the second end of the cable and provided with two lateral, diametrically opposed recesses that are oriented parallel to a longitudinal direction of the lock body. Two locking bolts are insertable into the recesses in a translatory manner in the longitudinal direction of the lock body for securing the insertion pin in the lock body. The locking bolts form a part of a locking device. A driver, which lies with inner ends in an effective area of the drive, is rotatable by means of a closing cylinder. By actuation of the closing cylinder, the locking device is drivable in the longitudinal direction of the lock body. The locking device has a first section extending in the longitudinal direction of the lock body and a second, bracket section oriented perpendicular to the lock body longitudinal direction on its outer end. The locking bolts, which are preferably cylindrical, are insertable into the first and second sections on opposite sides of the bracket section.

4 Claims, 4 Drawing Sheets

U.S. PATENT DOCUMENTS 4,881,387 A * 11/1989 Kortenbrede ..... 70/39
4,918,949 A * 4/1990 Newbold ..... 70/38 A
5,189,893 A * 3/1993 Kortenbrede ..... 70/38 A
5,331,830 A * 7/1994 Su ..... 70/38 A
5,394,712 A * 3/1995 Chou ..... 70/38 A
5,398,529 A * 3/1995 Goldman et al. ..... 70/38 A
5,417,092 A * 5/1995 Iu ..... 70/38 A
5,440,904 A * 8/1995 Su ..... 70/18
5,490,402 A * 2/1996 Shieh ..... 70/39
5,640,861 A * 6/1997 Chen ..... 70/38 A
5,669,254 A * 9/1997 Lee ..... 70/38 A
5,823,021 A * 10/1998 Chang ..... 70/38 A
5,950,461 A * 9/1999 Tsai ..... 70/38 A
5,987,940 A * 11/1999 Chang ..... 70/38 A
6,026,663 A * 2/2000 Tsung-Chuan et al. ..... 70/39
6,584,815 B2 * 7/2003 Bremicker ..... 70/38 A
6,666,051 B1 * 12/2003 Li ..... 70/14
6,694,781 B1 * 2/2004 Li ..... 70/14
7,036,344 B2 * 5/2006 Gast et al. ..... 70/38 A
7,513,133 B2 * 4/2009 Muerza ..... 70/233
7,665,333 B2 * 2/2010 Shabtay et al. ..... 70/38 A
2006/0059962 A1 * 3/2006 Shabtay et al. ..... 70/49
2007/0240459 A1 * 10/2007 Fantl et al. ..... 70/38 A
2009/0025433 A1 * 1/2009 Evans ..... 70/49
2009/0049875 A1 * 2/2009 Buhl et al. ..... 70/52
2009/0158792 A1 * 6/2009 Lasaroff ..... 70/38 A
2009/0314141 A1 * 12/2009 Weinstein et al. ..... 81/180.1
2009/0320531 A1 * 12/2009 Shabtay et al. ..... 70/49

* cited by examiner

BICYCLE LOCK

CROSS REFERENCE TO RELATED APPLICATIONS

The present application is a divisional application of U.S. application Ser. No. 11/231,526 filed Sep. 21, 2005 now U.S. Pat. No. 7,665,333.

BACKGROUND OF THE INVENTION

The invention relates to a bicycle lock in the form of a cable lock, comprising a lock body and a cable the first end of which is fixed to the lock body, while the second end of the cable is fixed to an insertion pin for insertion into an insertion opening of the lock body.

DE 43 22 989 C2 discloses a U-shaped lock with a U-shaped closure bracket and an elongated lock body, which has insertion openings for insertion pins of the closure bracket on both of its ends, which are provided with a lateral recess oriented parallel to the longitudinal direction of the lock body. For securing the insertion pins of the closure bracket within the lock body, locking bolts are provided which form a part of oppositely moveable locking devices and are moveable in a translatory manner in the longitudinal direction of the lock body. The locking devices lie with their inner ends in the region of a driver that is rotatable by means of a closing cylinder, by means of whose actuation, the locking devices can be driven in the longitudinal direction of the lock body.

While the known U-shaped lock comprises two insertion pins each on one end of the U-shaped closure bracket, a cable lock only comprises one insertion pin at the free end of the cables.

DE 94 07 300 U discloses a U-shaped lock, in which the closing bracket has a series of throat areas, which lie spaced from one another in the longitudinal direction along its two opposite ends. Each throat area is defined by two opposite lateral grooves and an inner groove, which is connected with the lateral grooves. The U-shaped lock also has a locking cylinder, which is disposed within a housing, and an axial pin. In addition, the U-shaped lock has a gear wheel, which is attached to the axial pin. The gear wheel is rotatable by the locking cylinder by means of a key. Two locking displacement plates are provided, whereby each plate has a toothed region on one end which engages with the gear wheel on one side. Additionally, a slot is provided, which is connected with an arched opening on the opposite end of the plate. By rotating the gear wheel in a selected direction, the locking displacement plates are moved away from one another, so that the slot of each locking displacement plate moves into engagement with a throat region to each end of the bracket for locking the bracket. By rotating the gear wheel in the opposite direction, the locking displacement plates are moveable toward one another, so that the slot of each locking displacement plate is distanced from each end of the bracket, whereby the locking of the closure bracket is reversed.

SUMMARY OF THE INVENTION

The invention is based on the object of producing a more simplified and improved cable lock in which in the locked state, higher and more secure locking forces act on the insertion pin than in the case with known locks.

The object is solved by a cable lock having an elongated lock body; a cable having first and second ends. The first end is fixed to one end of the elongated lock body and another end of the lock body has an insertion opening for an insertion pin that is attached to the second end of the cable and that is provided with two lateral, diametrically opposed recesses that are oriented parallel to a longitudinal direction of the lock body. A locking device, which is moveable in a translatory movement in a longitudinal direction of the lock body, is in the form of a unitary member consisting of a first, elongate section extending in the longitudinal direction of the lock body and a second, bracket section disposed at an end of said first elongate section and extending perpendicularly relative to the longitudinal direction of the lock body and to the first section over an angle in a range of 180° or more and having diametrically opposed recesses on diametrically opposed ends. Each of the diametrically opposed ends supports two substantially cylindrical locking bolts for engagement in the two diametrically opposed recesses of the insertion pin for securing the insertion pin within the lock body. The locking device and the two substantially cylindrical locking bolts supported by said locking device are moveable together as a unit; the inner end of the locking device is disposed to lie directly within an effective range of a driver that is rotatable by means of a closing cylinder. By means of actuation of the closing cylinder, the locking device is drivable in the longitudinal direction of the locking body. Driver elements mounted on the locking bolts engage in the recesses of the bracket section.

It is an essential feature of the present invention that the locking bolts and the locking device are different elements to be handled separately from one another. This is advantageous because the locking bolt with this separate design can comprise a different material from that of the locking device. Advantages arise in particular, because the locking bolts are exposed to high effects of force upon forced, undesired attempts to open the lock, and because of this, must be made from a particularly hard and high-quality, expensive material. The locking devices, in contrast, serve only for force transfer during the opening and closing processes and therefore can be made from a different material than the locking bolt, therefore providing cost savings.

BRIEF DESCRIPTION OF THE DRAWINGS

The invention will be described in greater detail with reference to the drawings, in which.

DETAILED DESCRIPTION OF SPECIFIC EMBODIMENTS

Figure 1:
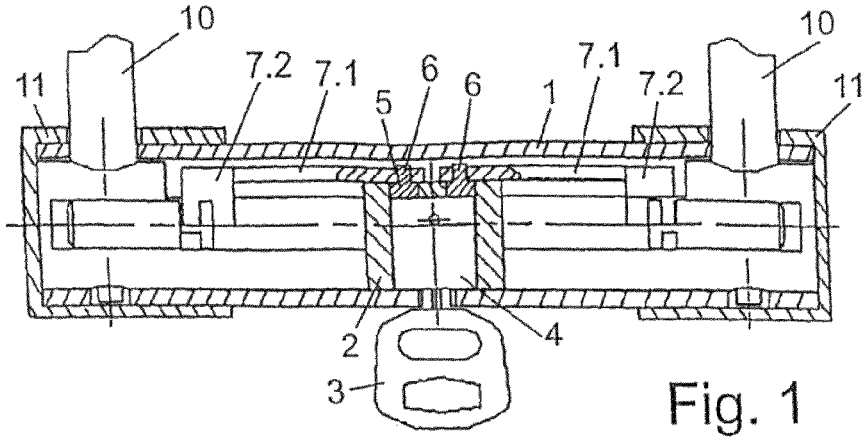
FIG. 1 shows partly in section a side view of the bicycle lock formed as a U-shaped lock in a locked condition.

According to FIG. 1, an elongated, preferably cylindrical lock body 1 is provided, in its central region, with a receiving chamber 2 for a closing cylinder 4 (shown only schematically) that can be actuated by means of a key 3. A disk-shaped driver 5 is secured to the closing cylinder, and supports two substantially diametrically opposed driver pins 6. These driver pins 6 serve to drive two locking devices 7 that are moveable in a translatory manner within the lock body 1 in the longitudinal direction of the lock body. Each locking device comprises a section 7.1 extending in the longitudinal direction of the lock body and a bracket section 7.2 connected thereto that is oriented perpendicular to the longitudinal direction of the lock body. The bracket section 7.2 extends over an angle range of approximately 180° or more and has two substantially oppositely disposed recesses 7.4', see FIG. 12. In these recesses, driver elements 8.1 mounted on the locking bolts 8 engage, such that the locking bolts 8 follow the movement of the locking devices 7.

Figure 5:
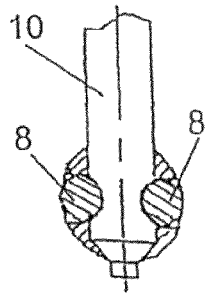
FIG. 5 shows in section a view of a closure bracket end in a locked state.
Figure 6:
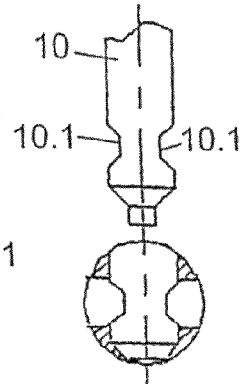
FIG. 6 shows the closure bracket end before insertion into the lock body.

The lock body 1, covered on the end by caps 11, is provided in its end regions with insertion openings 1.1 for inserting insertion pins 10 provided at the ends of a substantially U-shaped closure bracket (not shown in detail). Each closure bracket end 10 is provided with two diametrically opposed recesses 10.1, as shown in FIG. 6, in which the cylindrical locking bolts 8 engage in the locked condition shown in FIGS. 1, 2, and 5.

Figure 2:
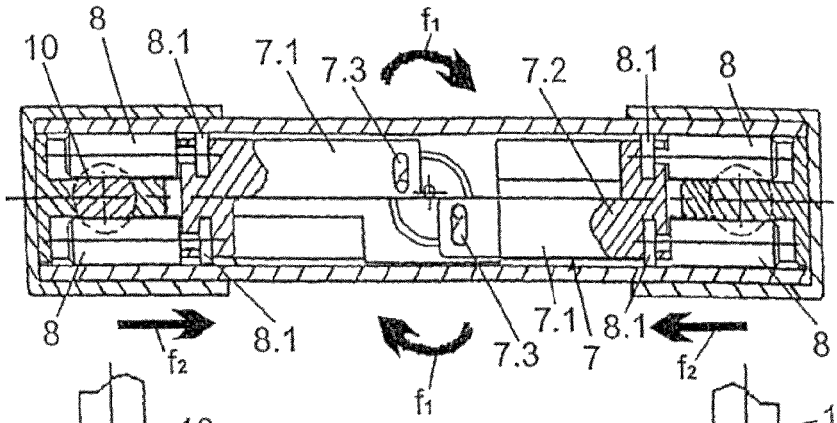
FIG. 2 shows a view rotated by 90° relative to the view shown in FIG. 1 in a partly sectional view of the U-shaped lock.
Figure 4:
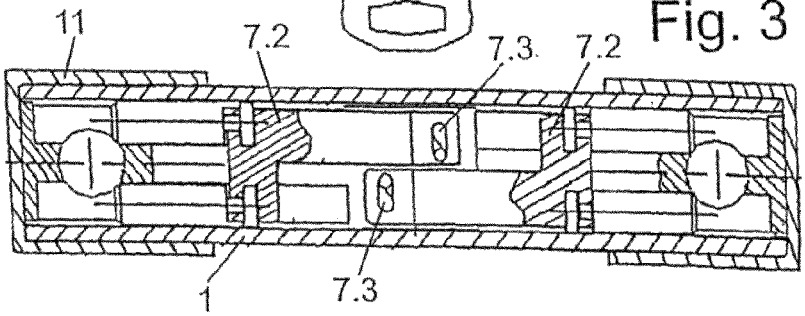
Figure 7:
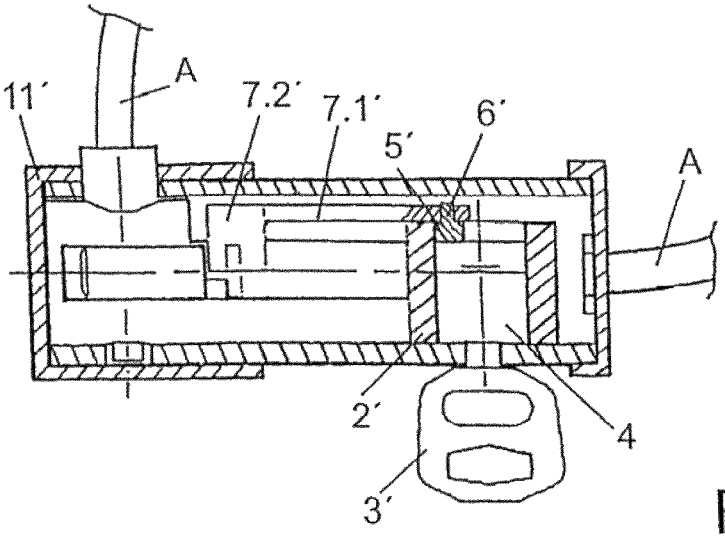
FIG. 7 shows partly in section a side view of the bicycle lock formed as a cable lock in a locked condition.
Figure 8:
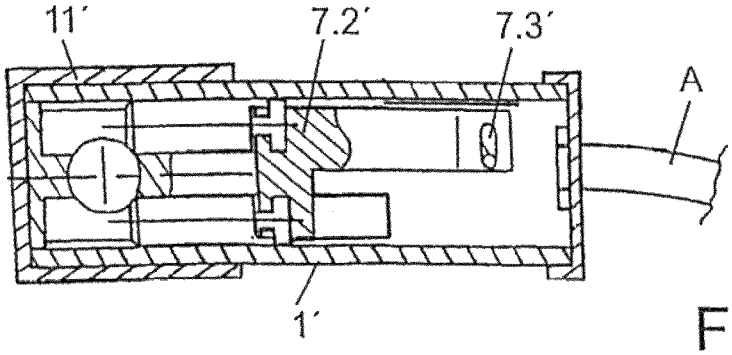
FIG. 8 shows a view of the cable lock in an unlocked condition before insertion of the free cable end.
Figure 9:
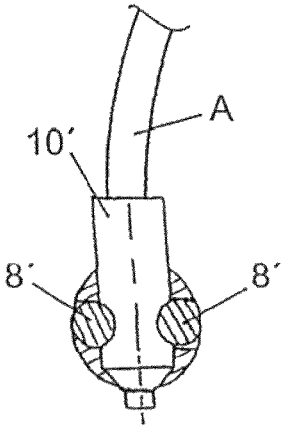
FIG. 9 shows in sectional view a view of the free cable end in a locked condition.
Figure 10:
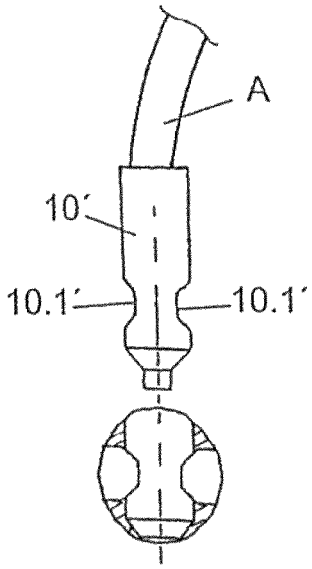
FIG. 10 shows the free cable end before insertion into the lock body.

The locking devices 7 are provided with guide tracks 7.3 extending perpendicular to their direction of movement and preferably formed as slots, as shown in FIGS. 2 and 4, in which drive pins 6 engage.

Figure 3:
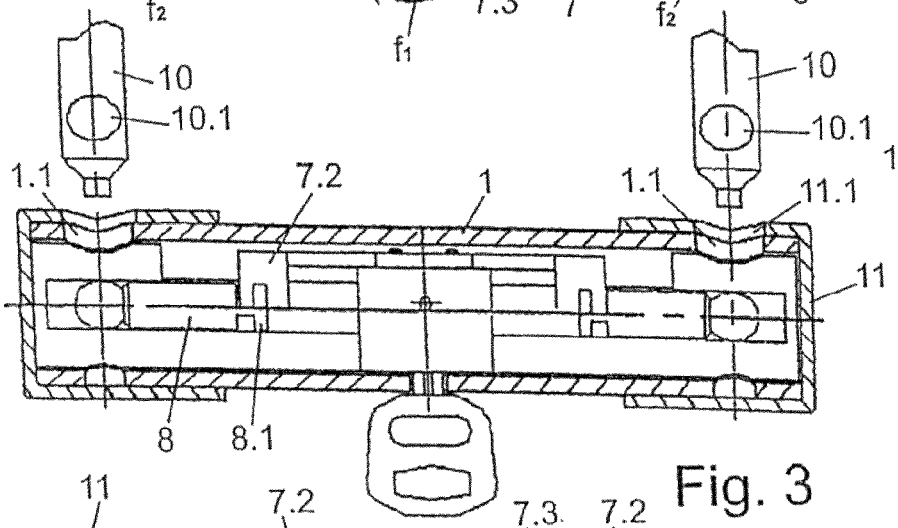
FIGS. 3 and 4 show views of the U-shaped lock corresponding to FIGS. 1 and 2 before insertion of the closure bracket ends into the lock body.

By rotating the key 3 in the direction of the arrow f1, the locking devices 7 are pulled inwardly from the locked position shown in FIGS. 1 and 2 in the direction of the arrow f2 into the unlocked state shown in FIGS. 3 and 4, so that the locking bolts 8 release the closure bracket ends 10.

The driver 5 can be biased in a known manner (not shown) by means of a spiral spring in the direction of the locking position of the locking devices.

The cable lock as shown in FIGS. 7 through 10 corresponds essentially to the half of the U-shaped lock shown to the left in FIGS. 1 and 4. For this reason, the individual elements of the cable lock that are the same as the individual elements of the U-shaped lock shown in FIGS. 1, 4, 5, and 6 are provided with primes. The cable lock according to FIGS. 7 through 10 includes a cable A, whose first end is attached to one end of an elongated lock body 1'. On the second end of the cable, an insertion pin 10' is attached, which is provided with two lateral, diametrically opposed recesses 10.1' that are oriented parallel to the longitudinal direction of the lock body 1'. For securing the insertion pin 10' within the lock body 1', two locking bolts 8' that can move in a translatory manner into the recesses 10.1' in the longitudinal direction of the lock body 1' are provided, which form a part of the locking device 7', which lies with its inner end in the effective area of a driver 5' that is rotatable by means of a closing cylinder 4'. By actuation of the driver 5', the locking unit 7' can be driven in the longitudinal direction of the lock body 1'. The locking device 7' has a section 7.1' that extends in the longitudinal direction of the lock body 1', as well as a bracket section 7.2' on its outer end, which is oriented perpendicular to the longitudinal direction of the lock body. In this bracket section 7.2', substantially cylindrical locking bolts 8' are inserted on opposite sides.

The bracket section 7.2' extends over an angle range of approximately 180° or more and is provided with recesses 7.4', in which driver elements 8.1' provided on the locking bolts 8' engage. The driver 5' supports a driver pin 6' eccentric to its axis of rotation, which engages in a guide track that is disposed in the region of the inner end of the locking device 7', and that extends substantially perpendicular to the direction of movement of the locking device. Each guide track 7.3' is preferably formed as a slot. The driver 5' is biased particularly by means of a spiral spring (not shown) in the direction of the locking position of the locking device 7'.

Figure 11:
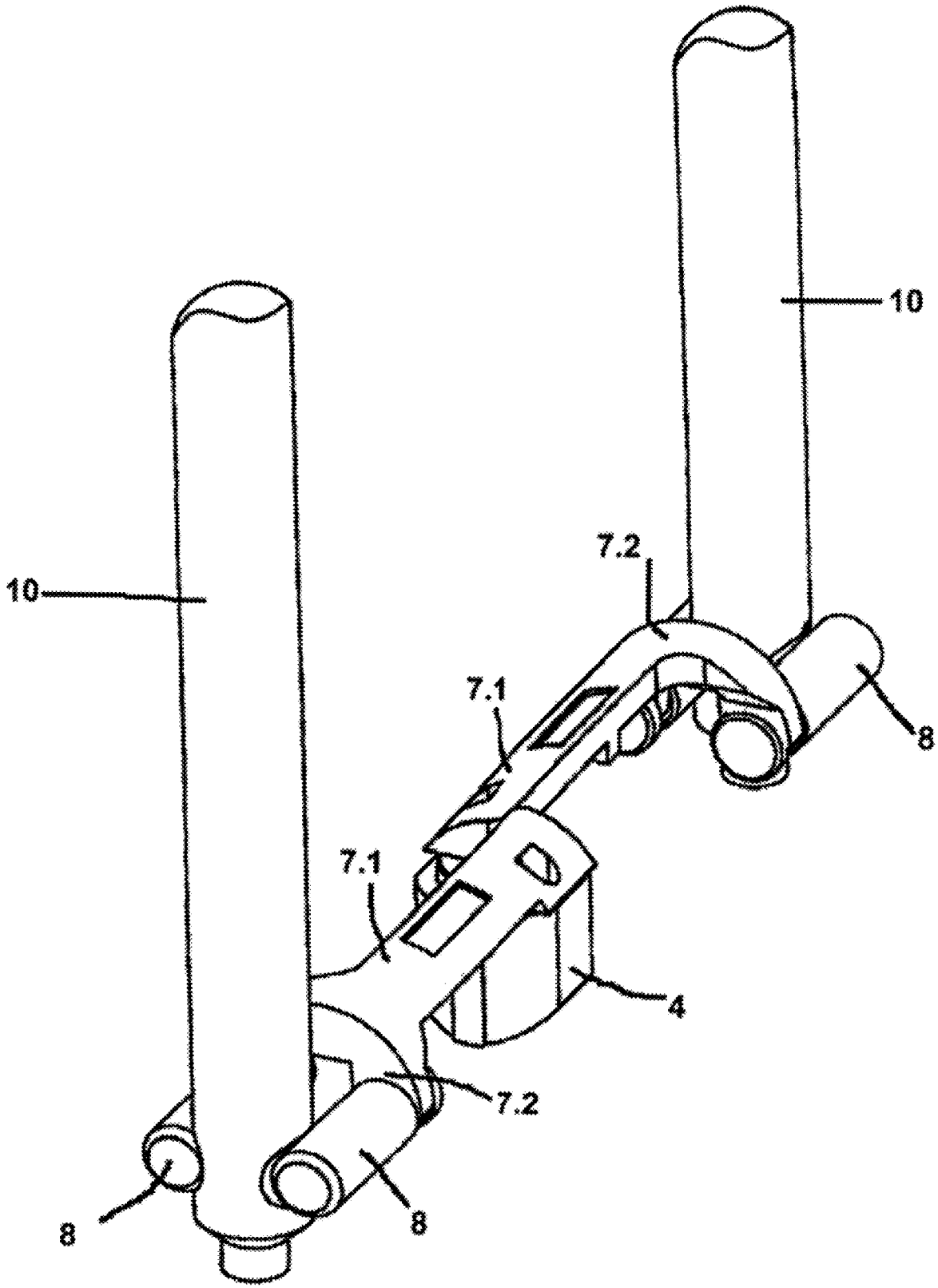
FIGS. 11 and 12 show exploded views of the locking device of a cable lock at the inside of the lock body.
Figure 12:
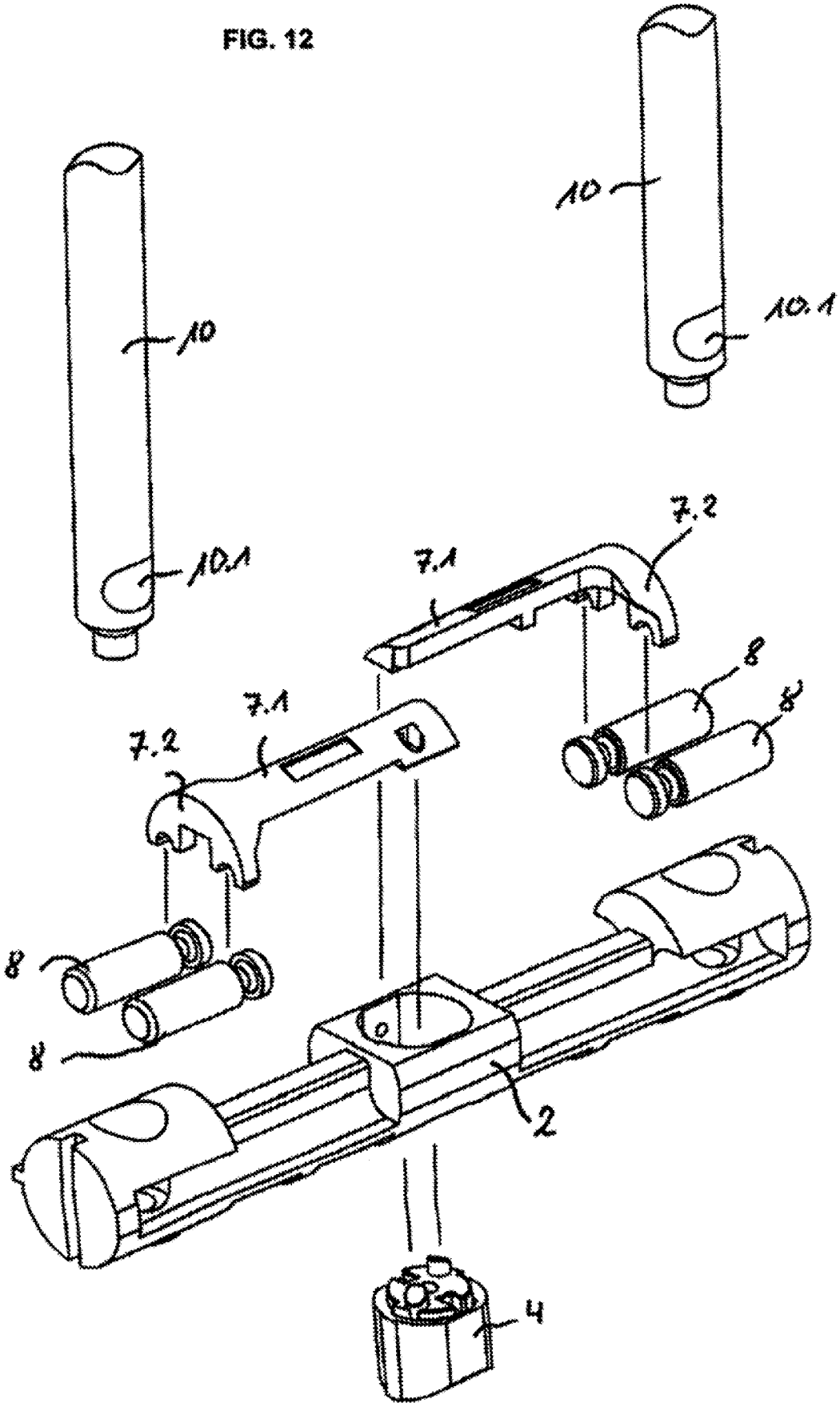

FIGS. 11 and 12 show in exploded views more detailed representations of the inside of the locking device 7' of the cable lock, utilizing the features and reference numerals of FIGS. 7 through 10.

The invention claimed is

1. A bicycle lock in the form of a cable lock, comprising:

an elongated lock body;

a cable having first and second ends, wherein the first end is fixed to one end of the elongated lock body and wherein another end of the lock body has an insertion opening for an insertion pin that is attached to the second end of the cable and that is provided with two lateral, diametrically opposed recesses that are oriented parallel to a longitudinal direction of the lock body; and one locking device, which is moveable in a translatory movement in a longitudinal direction of the lock body, wherein the locking device is in the form of a unitary member consisting of a first, elongate section extending in the longitudinal direction of the lock body and a second, bracket section disposed at an end of said first elongate section and extending perpendicularly relative to the longitudinal direction of the lock body and to the first section over an angle in a range of 180° or more and having diametrically opposed recesses on diametrically opposed ends, wherein each of said diametrically opposed ends supports two substantially cylindrical locking bolts for engagement in the two diametrically opposed recesses of the insertion pin for securing the insertion pin within the lock body, wherein said locking device and the two substantially cylindrical locking bolts supported by said locking device are moveable together as a unit, wherein the inner end of the locking device is disposed to lie directly within an effective range of a driver that is rotatable by means of a closing cylinder, wherein by means of actuation of the closing cylinder, the locking device is drivable in the longitudinal direction of the locking body, and wherein driver elements mounted on the locking bolts engage in said recesses of said bracket section.

2. The bicycle lock of claim 1, wherein the driver supports a driver pin eccentrically to its axis of rotation, wherein the driver pin engages in a guide track mounted in the area of the inner end of the locking device, and wherein the guide track extends substantially perpendicular to the movement direction of the locking device.

3. The bicycle lock of claim 2, wherein each guide track is formed as a slotted hole.

4. The bicycle lock of claim 2, wherein the driver is prestressed by means of a spiral spring in the direction of the locking position of the locking device.

* * * * *